United States Patent [19]

Tanigawa et al.

[11] 4,233,594

[45] Nov. 11, 1980

[54] FIRE DETECTION AND OBSERVATION SYSTEM

[75] Inventors: Takeshi Tanigawa, Machida; Yukio Yamauchi, Kawasaki, both of Japan

[73] Assignee: Hochiki Corporation, Tokyo, Japan

[21] Appl. No.: 38,954

[22] Filed: May 14, 1979

[30] Foreign Application Priority Data

May 18, 1978 [JP] Japan ..... 53/59092

[51] Int. Cl.[2] ..... G08B 25/00

[52] U.S. Cl. ..... 340/525; 340/506

[58] Field of Search ..... 340/506, 524, 525, 500

[56] References Cited

U.S. PATENT DOCUMENTS 3,986,182 10/1976 Hackett ..... 340/525

4,095,220 6/1978 Sadler ..... 340/524

*Primary Examiner*—Alvin H. Waring

*Attorney, Agent, or Firm*—Jordan and Hamburg

[57] ABSTRACT

Fire observation system comprises a central receiving device and detectors, said central receiving device being provided with a remotely searching means for generating detection mode changing signals to continuously change the quantity of detection from a small value to a large one by means of electrical output units, which are connected to the detectors and can feed an output corresponding to the quantity of detection detected by each of detectors, and each of detectors being provided with an intrinsic signal feeding means for causing each of detectors to receive the detection mode changing signal and feed to the central receiving device the quantity of detection detected by the detector at the place where a fire is developing. Said fire observation system is intended to observe the condition of area surrounding a place where a fire is broken and search the development of fire at the place, after the break of fire is warned by detecting a predetermined reference value of a matter such as smoke, temperature and light.

5 Claims, 13 Drawing Figures

FIRE DETECTION AND OBSERVATION SYSTEM

BACKGROUND OF INVENTION

The present invention relates to a fire observation system capable of not only searching the condition of a place where a fire has broken but also remotely observing all area including the place to be observed from the viewpoint of safety and security, and by which the development of fire at all area can be observed and of which maintenance can be effectively attained.

British Pat. No. 1,478,952 discloses an electrical circuit of smoke detection device of ionization or photoelectric type wherein a switching circuit is controlled in the operation thereof by a combination of Zener diodes for converting the resistance of switching circuit to two small and large values corresponding to the voltage impressed, and an output unit is arranged to feed two large and small outputs after the resistance of threshold component is converted two small and large values by means of switching circuit.

However, even if a plurality of these conventional fire detectors arranged in all area to be observed and protected from fire serve to feed only two outputs to the central receiving device, it is impossible to observe the development of fire in the area or the safety condition of area.

The prior art could not use effectively and fully from the viewpoint of technology the feature that the electrical output unit provided with a usual fire detection device such as smoke detector of ionization or photoelectric type and temperature detector of thermistor or semiconductor type can change the output requirement thereof, namely the detected value of detector by changing the bias voltage impressed to the input terminal thereof. In addition, the prior art had no hard and soft wares necessarily enough to cause the detectors to feed searching detection information ranging from a small value to a large one as well as information assigned to each of detectors, so that the prior art was remarkably disadvantageous in that a fire observation system, which is high in reliability and preferable in maintenance, needed an extremely high cost.

SUMMARY OF INVENTION

The object of present invention is to provide an easily maintained and highly improved fire observation system of high reliability including a central receiving device, said central receiving device having a detection mode changing means for feeding detection mode changing signals to the output control gate of an elecrical output unit arranged in each of detectors so as to cause the detectors to periodically search the quantity of detection from a small value to a large one, the output circuit of electrical output units being provided with intrinsic oscillation means; an intrinsic signal receiving means for receiving first outputs fed from the electrical output units responding to one of detection mode changing signals, said outputs having intrinsic frequencies which can be separated from one another; and display means for displaying the mode signals and information assigned to each of detectors by means of second outputs fed from the intrinsic signal receiving means responding to the first outputs.

Since the group of detection mode changing signals are set to have relatively smaller frequencies than the ones of signals to be fed back from the detectors, the system of present invention is allowed to connect a plurality of detectors to two current supply lines extending from the central receiving device. The basical feature attained by the simple information signal system of present invention will provide many advantages, even if the detectors are separately connected to the central receiving device. For the purpose of causing the detectors to detect a parameter such as smoke, temperature and light from a small value effective to the forecast of fire, through a reference value teaching the real break of fire, to a large value effective to judge whether fire is really broken or one of detectors is wrongly operated, the quantity of detection detected by the detectors can be changed by changing the output requirement of output control terminals of electrical output units, to which are applied outputs responding to the quantity of detection detected by the detectors. As described above, the detection mode changing signals can cover an extent of detection mode ranging from a high sensitive signal causing the electrical output units to feed an output when the detectors detect a small quantity of matter, through a reference sensitivity signal causing the electrical output units to feed an output when a reference quantity of detection is made by the detectors, to a low sensitive signal causing the electrical output units to feed an output when the detectors detect a large quantity of matter enough to search the development of fire after a fire has broken. In other words, the detection mode changing signals are arranged to change their input voltages, most simply, in at least three stages in a period. This period lasts preferably few seconds or minutes, but it may be shorter or longer depending on the intended object of system. At the initial stage of detection mode changing range, it is possible to know whether or not any change of matter is detected to forecast the break of fire by means of surrounding detectors, at the middle stage the surrounding detectors are caused to detect whether or not the forecast change of matter is declared to be really the break of fire, and at the later stage the progress of fire can be observed at the fire observation center. Since the changes in the quantity of matter detected by the group of detectors are transmitted to the center every period of detection mode changing signals, the system of present invention can reliably search and observe the changes in condition at the area to be observed from the viewpoint of safety and security.

In an example of system arranged to perform a highly complicated operation, the detection mode changing signals capable of substantially changing the quantity of detection of detectors include a low sensitive signal allowing the output units to feed outputs only when the maximum quantity of matter is detected to teach that the detectors are wrongly operated because of the attachment of dewdrops or the entering of insects, and a high sensitive signal allowing the output units to feed outputs when there is detected an extremely small quantity of matter which has nothing to do with the break of fire. The high sensitive signal serves especially to teach that the system is rightly operated. In the example of system in which the detection mode changing signals are arranged to change their input voltages in three stages, the high sensitive signal is added at the initial stage and the low sensitive signal is added at the later stage. The outputs obtained from the detectors responding to the low and high sensitive signals are displayed by the display means of central receiving device, thus enabling a reliable management of system to be attained.

Depending on the intended function of system, it is preferable to decrease or increase the number of mode detection signals belonging to the initial, middle and later stages, respectively.

As stated above, the detection mode changing signals fed from the central receiving device to the electrical output unit of each of detectors are supplied to sensitivity detecting means, which feed outputs when the detection mode changing signals and the intrinsic signals of detectors are applied thereto. Accordingly, the detection information of detectors is removed from the information signals transmitted between the detectors and the central receiving device and read by the central receiving device.

As long as the detection mode changing signals can be separated from the intrinsic signals which are information assigned to the detectors, respectively, the detection mode changing signals may be ones changing continuously in a period including the initial, middle and later stages, or changing in step-like manner, or changing in saw-tooth wave form, or ones obtained from a combination of them. The detection mode changing signals and the intrinsic signals may be treated through individual lines, if necessary.

DETAILED DESCRIPTION OF PREFERRED EMBODIMENTS

Figure 1:
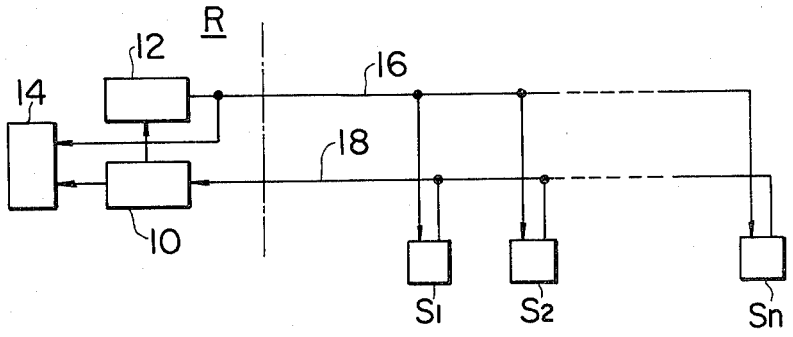
FIG. 1 is a block diagram of circuit showing a basic fire observation system of present invention.

In FIG. 1, a receiving device R comprises an intrinsic signal receiving circuit section 10 for receiving and reading an intrinsic signal fed from one of detectors and displaying warningly the break of fire at the place where said detector is located, a circuit section 12 for commanding the change of detection mode and feeding detection mode changing signals to each of detectors so as to substantially change the quantity of detection in continuous or step-like manner, a detection mode detecting circuit section 14 for remotely detecting the quantity of detection in the detector, which fed the intrinsic signal, responding to the output signals of circuit section 12 when the intrinsic signal is received by the intrinsic signal receiving circuit section 10, and a plurality of detectors S1, S2 - - - Sn commonly connected to the receiving device R through a detection mode changing signal line 16 and an intrinsic signal line 18. As will be described later, each of detectors S1, S2, - - - Sn is arranged to feed an intrinsic signal having a natural frequency when the quantity of physical change of a matter, for example, the density of smoke exceeds a threshold value and provided with an output control circuit section for changing the quantity of detection responding to detection mode changing signals fed from the circuit section 12 of receiving device R.

Figure 2:
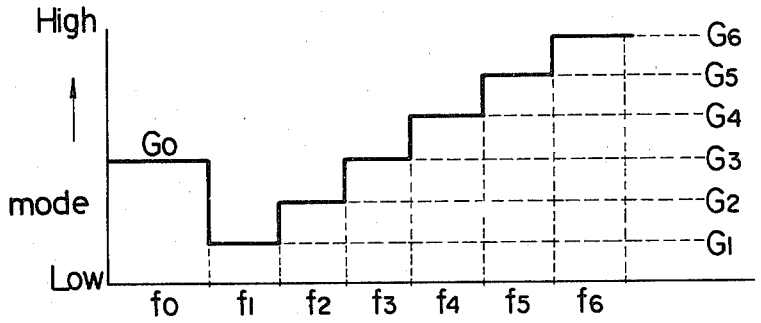
FIG. 2 is a graph showing the relation between the frequencies f0–f6 of detection mode changing signals for changing the quantity of detection of detectors and the quantities G1–G6 of matter to be detected.

FIG. 2 shows a relation between the frequencies f0, f1, f2, - - - f6 of detection mode changing signals fed from the circuit section 12 and quantities of detection G1, G2, - - - G6 detected by the detectors S1, S2, - - - S6 responding to the detection mode changing signals. Under the normal condition of observation, the circuit section 12 feeds a signal of frequency f0 through the detection mode changing signal line 16 to each of detectors S1, S2, - - - S6, setting their output detection values to a constant reference value G0. Assuming that the detector S1 issues a warning, the circuit section 12 feeds signals changing their frequencies to f1, f2, - - - f6 in step-like manner, responding to the intrinsic signal fed from the detector S1. The output detection value G1 set by the signal of frequency f1 is a maximum value under which each of detectors issues a warning responding to the attachment of dewdrops or the entering of insects into the detector, provided that the detectors are of smoke density detection type. When an intrinsic signal is obtained from the detector S1 at this time, the initial warning issued by the detector S1 is doubted to be due to the abnormal operation of detector S1. If an intrinsic signal is received from any one of detectors S2, S3, - - - Sn at the maximum value G1, it is believed that the detector which issued the initial warning was wrongly operated because the detection quantity of G0 was not received from the other detectors. When the intrinsic signal of detector S1 is received at a large detection quantity of G2 corresponding to a frequency of f2, and intrinsic signals of detectors S1, S2 and S3 at a larger detection quantity of G3 corresponding to a frequency of f3, the detector S1 serves to teach the progress of fire and the detectors S2 and S3 to teach that a fire is detected. Further, when the intrinsic signals of detectors S1–S4 are received at a second foreknowledge frequency f4, the ones of detectors S1–S5 at a first foreknowledge frequency f5, and the ones of detectors S1–S6 at a minimum detection frequency f6, warning is successively issued by the detectors S1, S2, - - - S6 as the detection mode of detectors is enhanced from G1 to G6 by the signals of frequencies f1, f2, - - - f6, and it can be read at the side of receiving device how the fire or smoke is developing. Since a constant relation is established between the detection quantities G1–G6 of detectors and the densities of smoke, the value of detection mode signal when an intrinsic signal is obtained can be read by the detection circuit section 14, to which same value of detection mode signal is impressed, thus allowing the density of smoke around the detector, which issued warning, to be read. In the case of continuously changing the frequencies from f1 to f6, the detection of quantities can be attained more accurately.

Assuming that the signal of frequency f6 sets the detection quantity of detectors to a minimum value G6 at which warning is issued regardless of the presence of smoke, all of detectors S1–Sn issue warning and their intrinsic signals are all received. When any of detectors is present whose intrinsic signal is not received at this time, it is believed that the detector is wrongly operated or that the wiring of detector to the central receiving device is broken. The detection mode changing operation of detectors attained by the above-mentioned central receiving device can be manually performed at the time of fire as well as regular checking of device, so as to easily check the operation of detectors and wiring.

Figure 3:
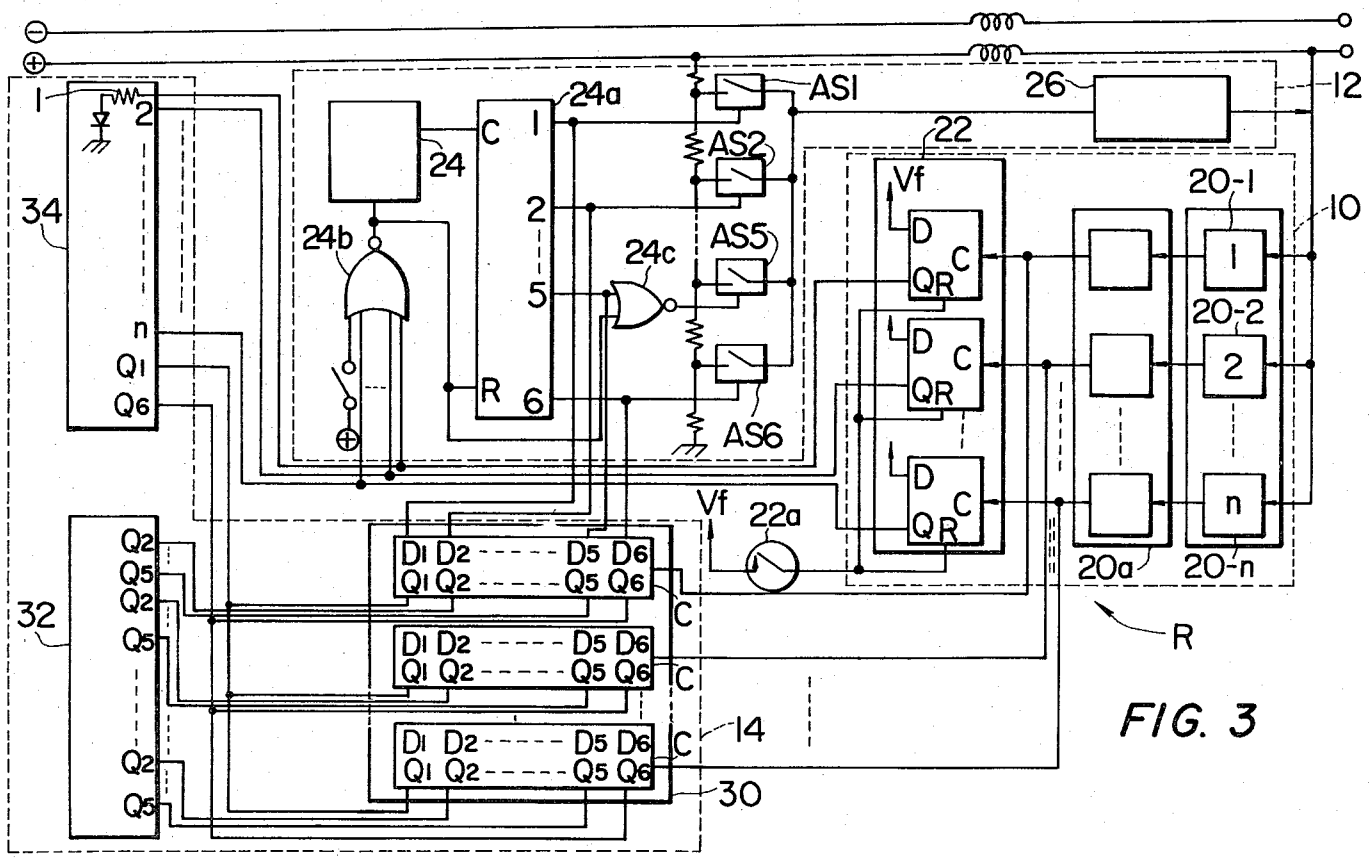
FIG. 3 is a circuit diagram showing the receiving device of fire observation system.

In a system shown in FIG. 3, a receiving device R has, as an intrinsic signal receiving circuit section, a number of intrinsic signal receiving circuits 20-1, 20-2, - - - 20-n corresponding to the number of detectors, and a first memory circuit 22 to memorize and maintain the outputs of intrinsic signal receiving circuits 20-1–20-n. A stable mono-multivibrator is employed as a control circuit 24, which is controlled by a NAND circuit 24*b* to change output voltages in continuous or step-like manner and serves to apply the outputs thereof to the clock terminal of a counter 24*a*, said NAND circuit 24*b* generating the logical sum outputs of memory circuit 22, which employs "D" flip flops as a circuit section for commanding the change of detection mode. The control gates of bilateral switches AS1–AS6 are connected to the output terminals 1–6 of counter 24*a*, and resistors connected in series to a plus current line are connected to the input terminals of bilateral switches AS1–AS6 in such a way that an additional resistor is added to every input terminal of bilateral switches. The output terminals of bilateral switches are connected to a V/F conversion circuit 26, which comprises a tuning fork oscillator for converting the output voltage of control circuit 24 to a change in frequency. From the V/F conversion circuit 26 are fed the detection mode changing frequencies f1, f2, - - - f6 shown in FIGS. 2 and 4. An OR circuit 24*c* is connected between the counter terminal 5, which feeds the reference detection mode signals, and the bilateral switch AS5. Reset signals are also applied to the OR circuit 24*c* from the NAND circuit 24*b*, said reset signals being applied to the reset terminal of counter 24*a* to reset the counter 24*a* and fed, as outputs, successively through the output terminals 1–6 of counter 24*a*. Clocked "D" latches are employed as a second memory circuit 30 for menorizing and maintaining the detection mode signal when the receiving circuits 20-1, 20-2, - - - 20-n feed outputs, said circuits 20-1, 20-2, - - - 20-n receiving the intrinsic signal of detector S which is operated to feed an output after receiving a detection mode changing output voltage. The mode signal memorized in the memory circuit 30 is displayed as a quantity of detection in a display circuit 32. An abnormal condition displaying circuit 34 is further provided to check and display the break and development of fire, the accident of detectors, the breaking detector and the wrong operation of detectors responding to the detection mode information memorized in the second memory circuit 30, to the latch terminals of which are applied the detection information assigned to each of detectors and memorized in the first memory circuit 22. The second memory circuit 30, fire displaying means 32, and abnormal condition displaying means 34 form a mode detection circuit 14.

The output terminals of intrinsic signal receiving circuits 20-1–20-n are connected to mono-multivibrator 20*a* respectively, to the output terminals of which are connected the corresponding clock terminals of "D" flip-flop type memory circuit 22. The output terminals Q of memory circuit 22 are connected to the corresponding input terminals 1-n of abnormal condition displaying means 34. The output terminals of memory circuit 22 are connected to the input terminals of NAND circuit 24*b*, respectively, and to the NAND circuit 24*b* is connected a plus reset signal line for optionally resetting the counter 24*a*, which continues to feed reference mode outputs, and causing a new periodical operation to be performed for normal or abnormal management. The data terminals D1–D6 of clocked "D" latches of n units are connected to the output terminals 1–4 of counter 24*a*, respectively, and the output terminals Q2–Q5, which feed fire detection mode signals when latched, are connected to the fire displaying means 32, respectively. The other latch output terminals Q1 and Q6, which receive abnormal detection mode signals as mentioned above, are connected to the input terminals Q1 and Q6 of abnormal condition displaying means 34, respectively, and when information assigned to each of detectors is displayed by this abnormal condition displaying means, it shows that the displays due to the input signals of input terminals Q1 and Q2 are detected by the abnormal detection mode signals. Information assigned to the detectors and fed through the receiving circuits 20-1–20-n are applied to the corresponding clock terminals of clocked "D" latches to latch and cause the detection mode signal, which is stayed in each of data terminals, to feed an output and this output causes a detection mode value, which belongs to same information, and therefore a change in detection mode value to be synchronizingly displayed. A switch 22*a* connected to the reset terminal of memory circuit 22 is intended to optionally reset the memory circuit 22 and to be operated at the same time with the plus reset line connected to the NAND circuit 24*b*.

Figure 5:
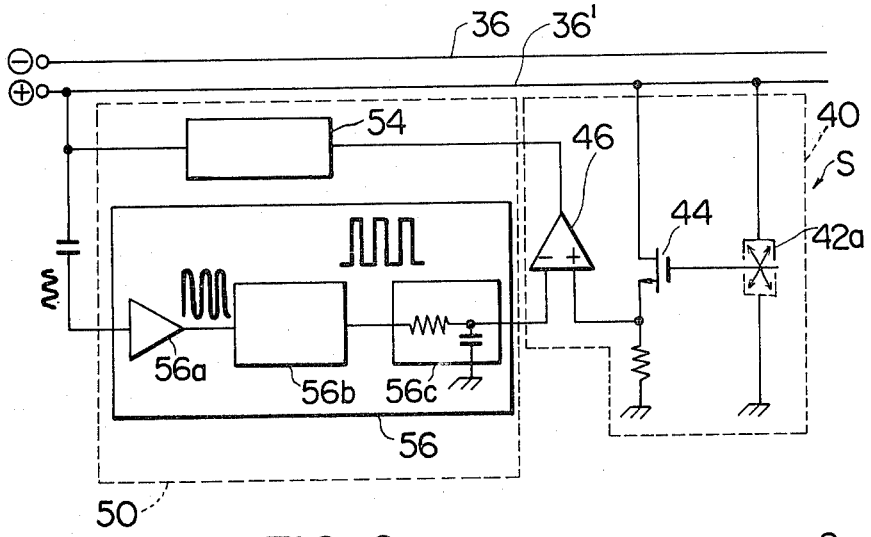
FIG. 5 shows a detector circuit of fire observation system.

A detector S shown in FIG. 5 is connected to the receiving device R through direct current supply lines 36 and 36' which are also used as signal transmitting lines in this example, and a detecting section 40 includes a field-effect transistor 44 gate-biased by a smoke detecting section 42*a* of ionization type, a comparator 46 for picking up the field-effect transistor 44 which is rendered conductive, and an intrinsic signal circuit 54 which is rendered operative by the output of comparator 46. To the other input terminal of comparator 46 is connected the output terminal of F/V conversion circuit 56, which comprises a circuit 56*a* for initially applying the detection mode changing signal, a circuit 56*b* for rectifying this amplified output and an integrating circuit 56*c* for further converting the output to a continuous signal.

Figure 6:
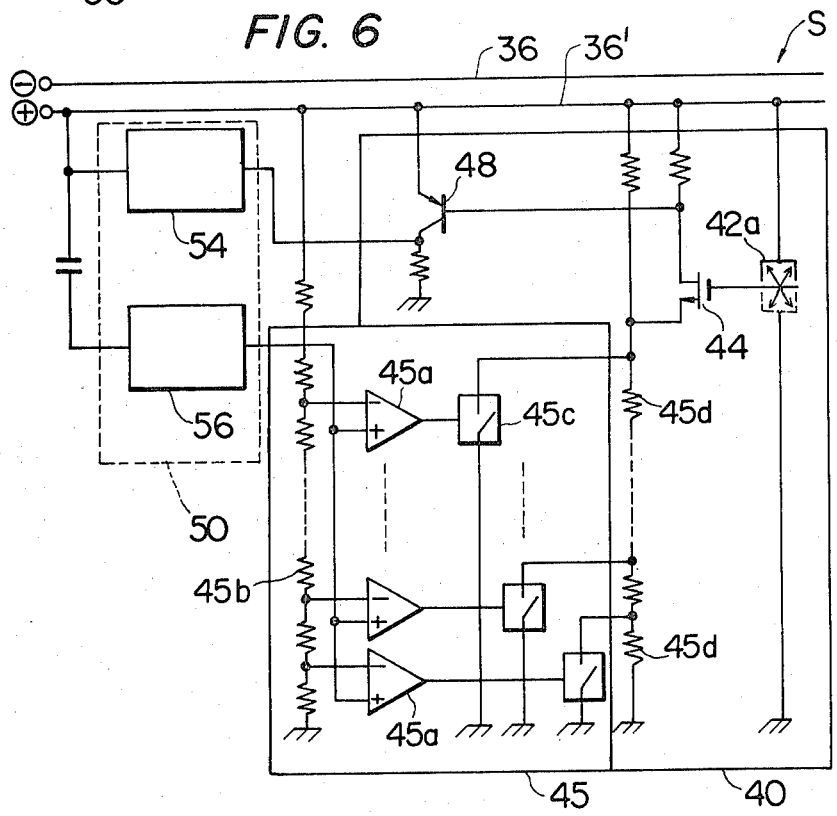
FIG. 6 shows another detector circuit of fire observation system.

In FIG. 6, a transistor trigger circuit 48 is triggered by a field-effect transistor 44 to feed trigger pulses, and each of comparators 45*a*, the input terminals of which are connected in series to the anode bias current line of field-effect transistor 44 through a plurality of resistors 45*b* corresponding to the detection mode changing number, is made different from one another in the output requirement thereof due to the number of resistors connected, said resistors being arranged between the current line and the comparators 45*a* in such a way that an additional resistor is added to every input terminal of comparators 45*a*. The other input terminals of comparators 45*a* are connected to the output terminal of F/V conversion circuit. A bilateral switch 45*c* is connected to the output terminal of each of comparators 45*a* and the output terminals of bilateral switches 45*c* are connected in series to the output control terminal of field-effect transistor 44 through a plurality of resistors 45*d*, which correspond in the number thereof to the above-mentioned resistors 45*b* and which are arranged between the output control terminal of field-effect transistor 44 and the output terminals of bilateral switches 45*c* in such a manner that an additional resistor is added to every output terminal of bilateral switches 45*c*. The field-effect transistor 44 is changed in the output requirement thereof according to the number of reisitors 45*d* connected.

Figure 7:
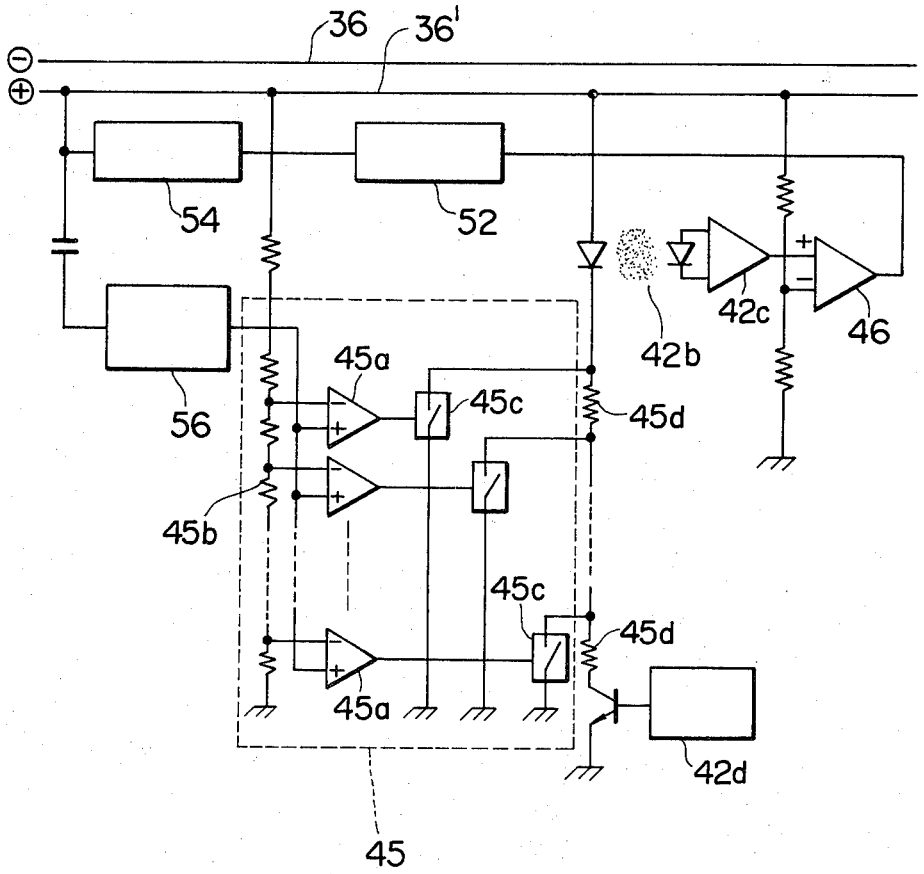
FIG. 7 shows a further detector circuit of fire observation system.

In FIG. 7, a photoelectric detector 42*b* is employed as a fire detector. A plurality of resistors 45*d* connected in series to a luminous phototransistor are switched through bilateral switches 45*c* to change the luminous quantity of luminous phototransistor and therefore to change the output requirement of amplifier 42*c* connected to a light receiving phototransistor. Namely, when the luminous quantity is decreased, an effect of detecting a small quantity of luminance can be attained while when increased, an effect of detecting a large quantity of luminance can be achieved. The output of amplifier 42*c* is amplified by an amplifier 46 to render a satble multivibrator 52 operative and then to cause an intrinsic signal oscillating circuit 54 to be oscillated.

When the receiving device R shown in FIG. 3 is combined with one of detectors shown in FIGS. 4 through 7, the operation of system thus formed will be as follows.

When the density of smoke around the detector S exceeds a reference level, the field-effect transistor 44 is rendered operative, the trigger circuit 48 is operated by the amplifier 46, the stable mono-multivibrator 52 contained in the intrinsic signal oscillator 54 feeds a warning pulse, and an intrinsic signal of frequency f8 is transmitted from the intrinsic signal oscillating circuit 54 through the current supply lines 36 and 36' to the receiving device R. The transmitted intrinsic signal is received by the intrinsic signal receiving circuit 20-1 which tunes to the frequency f8 and converted to an information, which is stored in a memory address of detector S1 of memory circuit 22. At the same time, the memory circuit 22 causes the second memory circuit 30 for the display circuit 32 to be latched to display the information of detector S1. The information of detector S1 is also transmitted as a starting signal to the control circuit 24, which causes the detectors S1, S2, - - - Sn to feed the detection mode changing signal successively through the counter 24*a*, and these voltage signals are converted by the V/F conversion circuit 26 to the frequencies f1, f2, - - - f6, which are transmitted through the current supply lines 36 and 36' to the detectors, respectively. The detection mode changing signals relative to all of detectors Sn including the detector S1 are again converted by the F/V conversion circuit 56 to voltage signals, and the source bias or anode bias of field-effect transistor is switched by the step-like changeover of switching elements of switching circuit 56 to change the quantity of detection in step-like manner. When the detector S1 detects a detection quantity G2 at the frequency f2 before it again issues a warning at a reference detection value corresponding to the reference detection sensitivity under which the break of fire is to be announced, for example, at a sensitivity G3 corresponding to the frequency f3, and feeds an intrinsic signal of frequency f3, this intrinsic signal is similarly received and converted by the intrinsic signal receiving circuit 20-1 to latch the memory circuit 30 and to transmit the mode signal G2 from the data terminal to the output terminal thereof, thus causing the density of smoke to be displayed by the display section of detector S1 in the display circuit 32. The development of fire can be observed like this through the fire detection line of detector S1.

In the case where the detector S1 is wrongly operated by the attachment of dewdrops, for example, the detector S1 is arranged to feed a signal responding to the detection mode changing signal of frequency f1 at which the maximum quantity G1 of detection is set, and a voltage signal for determining the detection mode G1 relative to the attachment of dewdrops of the like is stored in the memory circuit 30. Therefore, the abnormal condition detecting mode fed from the memory circuit 30 and the information assigned to the detector S1 are displayed in the abnormal condition displaying circuit 34 to teach that the detector S1 has been wrongly operated, and no fire warning is issued.

Since the detection quantity of detectors can be changed to the minimum detection quantity G6 by feeding a signal of frequency f6 to the detectors and all of detectors issue a warning at this detection quantity G6 regardless of the presence of smoke around the detectors, any one of detectors from which no intrinsic signal should be obtained at this time will be judged to have an accident or a breaking of line and this will be displayed by the abnormal condition displaying circuit 34.

In addition to the case where the detectors issue a warning as desribed above, the regular check of system can be naturally carried out even under the usual condition changing the detection quantity successively and checking at what detection quantity the detectors issue a warning, thus enabling the operation of detectors to be checked and the breaking of line to be detected.

In the above-mentioned embodiments, signals are employed to use frequencies. However, other voltage, pulse or the like may be employed.

Figure 8:
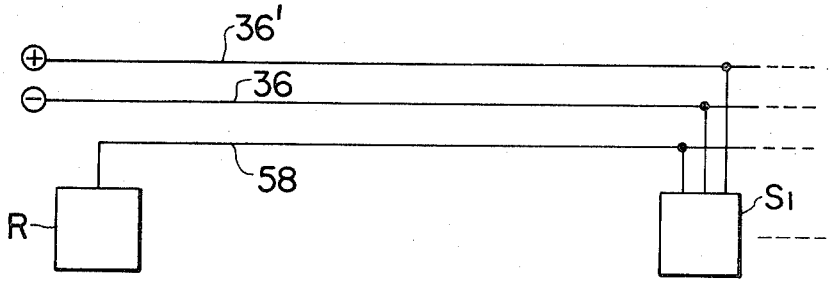
FIG. 8 is an example of wiring between a central receiving device R and detectors S1–Sn.

FIG. 8 shows a further embodiment, in which the receiving device R and detector S1 are same as those shown in FIG. 3, but three-line transmission is employed instead of two-line transmission shown in FIG. 1 by adding to the current supply lines 36 and 36' a signal line 58 for transmitting the intrinsic signals and detection mode changing signals therethrough.

Figure 4:
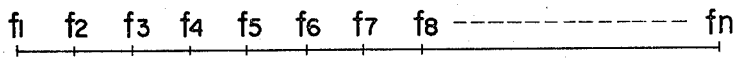
FIG. 4 shows an allotment of frequencies f1–f6 of detection mode changing signals and frequencies f8–fn of intrinsic signals applied to the detectors, respectively.
Figure 9:
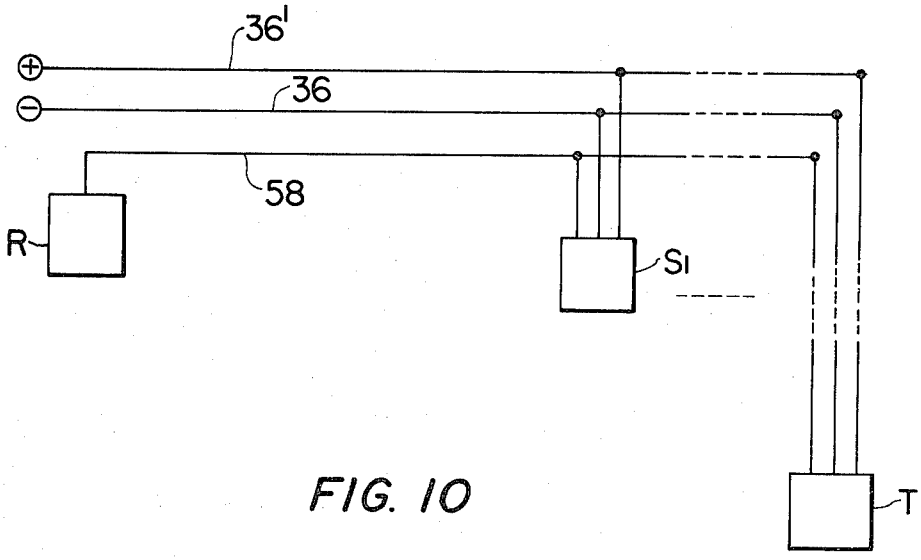
FIG. 9 is another example of wiring in which a means T for checking the breaking of wire is connected to the wiring between the central receiving device R and detectors S1–Sn.
Figure 10:
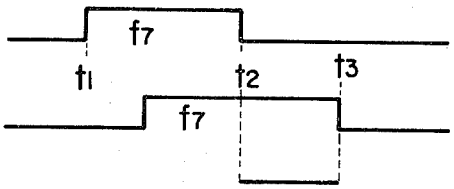
FIG. 10 is a time chart showing the relation between a wire observation signal f7 fed to the means T and signals responding to the wire observation signal f7.

FIG. 9 shows a still further embodiment in which a terminal means T is connected to three lines. A frequency f7 shwon in FIG. 4 is allotted to the terminal means T and used as a line observing signal. When the line observing signal of frequency f7 is automatically or manually fed from the receiving device R, the terminal means T feeds back the signal of frequency f7 to the receiving device R for a certain time length after receiving the signal, and it is checked at the side of receiving device R whether or not the feed-back of signal is obtained from the terminal means T. As shown in FIG. 10, for example, when the line observing signal of frequency f7 is fed from the receiving device R for a time length ranging from t1 to t2, the terminal means T responds to feed back the signal of frequency f7 till the time t3 and the feed-back of signal is detected during a time length ranging from t2 to t3 by the receiving device R, thus enabling the lines to be checked.

Figure 11A:
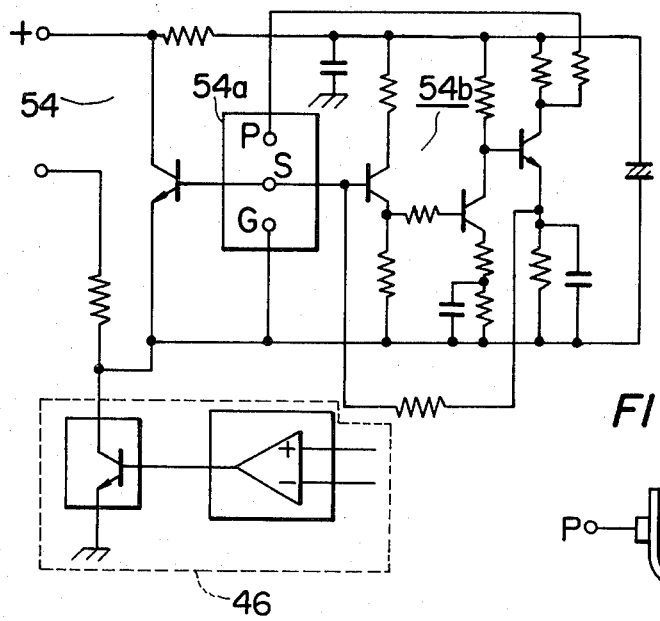
FIG. 11*a* is a circuit diagram showing an example of intrinsic signal generating means included in the detectors.
Figure 11B:
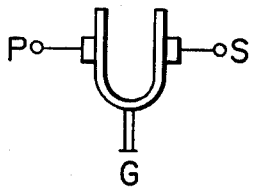
FIG. 11*b* shows the terminals of tuning fork oscillator shown in FIG. 11*a*.
Figure 12:
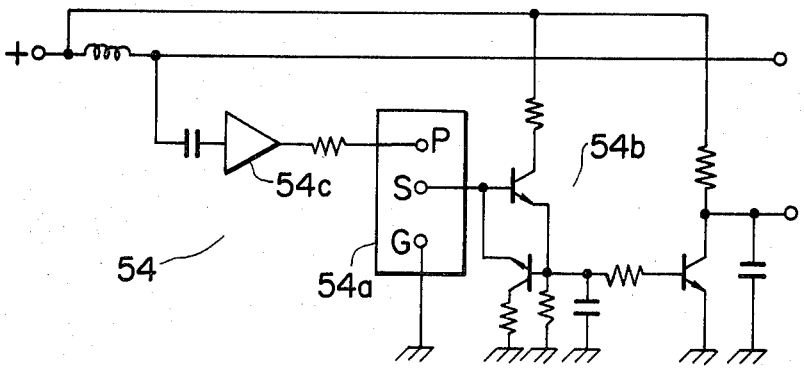
FIG. 12 is a circuit diagram showing another example of intrinsic signal generating means.

FIGS. 11*a* and 12 show examples of intrinsic signal oscillating circuit 54. These two examples employ a tuning fork oscillator shown in FIG. 11*b* as an oscillator. An oscillation control circuit 54*b* is inserted between the input magnetic terminal P and output magnetic terminal S of tuning fork 54*a*, and intrinsic signals are picked up through the output terminal. A supporting portion G is commonly earthed. Numeral 46 represents a comparator or semiconductor switching circuit, and 54*c* in FIG. 12 denotes an amplifier.

An example of combination between the frequencies and detection quantities shown in FIGS. 2 and 4 is shown in the following table.

TABLE

| | Example in business room or living room | | |
|---|---|---|---|
| Frequency | Smoke detector Smoke density | (Ionization type) (Photoelectric type) (Light reduction rate) | Temperature detector Temperature |
| f6 6KHz | 50%/m | | 130 C. |
| f5 5KHz | 40%/m | | 110 C. |
| f4 4KHz | 30%/m | | 90 C. |
| f3 3KHz | 20%/m | | 70 C. |
| f2 2KHz | 10%/m | | 50 C. |
| f1 1KHz | 0%/m | | 30 C. |

What is claimed is:

1. A fire observation system capable of detecting the break of a fire at a place and searching the development of fire at the place and at an area surrounding the place, said system comprising a central receiving device including a means having three output stages and forming detection mode changing signals so as to substantially feed three kinds of output, said three output stages comprising a first output stage for feeding first detection mode changing signals to detect an extent of relatively small quantity of matter, a middle output stage for feeding middle detection mode changing signals to detect an extent of reference quantity of matter, and a second output stage for feeding second detection mode changing signals to detect an extent of relatively large quantity of matter, a plurality of AND means having at least two input terminals and an output terminal, and feeding the values of impressed detection mode changing signals by impressing the output of detection mode change signal forming means to one of input terminals and applying a signal to the remaining input terminal, and a display means having the output values of AND means applied thereto and displayed therein; and a plurality of remote fire detectors including a plurality of fire detecting means for detecting a matter and feeding an electrical signal corresponding to the quantity of matter detected, fire signal output means equal in number to said fire detecting means and to which the electrical signals of fire detecting means and the detection mode changing signals are impressed to feed controlled outputs under the output requirement determined by these electrical signals and detection mode changing signals, and intrinsic signal feeding means receiving the outputs of fire signal output means to form an intrinsic signal allotted to each of fire detecting means and supplying the intrinsic signal to the remaining input terminal of AND means corresponding to the fire detecting means.

2. A fire observation system according to claim 1 wherein said detection mode change signal forming means include a control means for generating at least three different voltages in a period and a V/F converting means for periodically converting the output voltages fed from the control means, and said fire signal output means include a F/V converting means having the output terminal thereof connected to the terminal to which the detection mode changing signals are applied and the input terminal thereof connected to the V/F converting means.

3. A fire observation system according to claim 1 comprising said detection mode change signal forming means including a stable mono-multivibrator, a counter controlled by the vibrator, a resistance changing circuit connected to the output terminals of counter and changing output voltages in space with the outputs fed from the counter, and a V/F converting circuit connected to the output terminal of resistance changing circuit and converting the output voltages of resistance changing circuit synchronizingly with the output voltages fed from the resistance changing circuit;

said AND means including a plurality of first memory circuits to which the outputs fed from the terminal of counter are applied and which cause the outputs to be fed therefrom by the intrinsic signals;

a second memory circuit connected to the output terminal of intrinsic signal receiving circuit which receives the intrinsic signals of fire detecting means; and an intrinsic signal receiving means for picking up the memory of second memory circuit for a predetermined time length and causing the corresponding input memory of first memory circuit to be fed as an output.

4. A fire observation system according to claim 3 wherein the detection mode signals serving to detect the reference quantity of matter by the usual outputs fed from one of output terminals of counter are applied from the detection mode change signal forming means to each of fire signal output means in the fire detection means and the counter is reset by the intrinsic signals fed from the fire detection means by the reference detection mode signals to cause the detection mode changing signals to be fed therefrom successively.

5. A fire observation system according to claim 1 wherein the detection mode changing signals include a maximum detection mode signal for detecting the maximum quantity of matter and a minimum detection mode signal for detecting the minimum quantity of matter, and an abnormal condition displaying means is connected to the output terminals of AND means to which the maximum and minimum detection mode signals as well as the intrinsic signals fed from the fire detecting means are applied.

* * * * *